US010920987B2

(12) United States Patent
Myers et al.

(10) Patent No.: US 10,920,987 B2
(45) Date of Patent: Feb. 16, 2021

(54) APPARATUS AND METHOD FOR BURNING SOLID FUEL

(71) Applicants: Taylor Macks Myers, Hyattsville, MD (US); Ryan Patrick Fisher, Baltimore, MD (US)

(72) Inventors: Taylor Macks Myers, Hyattsville, MD (US); Ryan Patrick Fisher, Baltimore, MD (US)

(73) Assignee: MF FIRE, INC., Baltimore, MD (US)

( * ) Notice: Subject to any disclaimer, the term of this patent is extended or adjusted under 35 U.S.C. 154(b) by 662 days.

(21) Appl. No.: 15/680,529

(22) Filed: Aug. 18, 2017

(65) Prior Publication Data

US 2018/0051886 A1 Feb. 22, 2018

Related U.S. Application Data

(60) Provisional application No. 62/376,466, filed on Aug. 18, 2016.

(51) Int. Cl.

| | |
|---|---|
| ***F24B 5/02*** | (2006.01) |
| ***F24B 1/02*** | (2006.01) |
| ***F24B 15/00*** | (2006.01) |
| ***F24B 1/181*** | (2006.01) |
| ***F23B 80/04*** | (2006.01) |

(52) U.S. Cl.

CPC ..... *F24B 5/023* (2013.01); *F23B 80/04* (2013.01); *F24B 1/02* (2013.01); *F24B 1/181* (2013.01); *F24B 15/005* (2013.01)

(58) Field of Classification Search

CPC ..... F23B 60/02; F23B 80/04; F24B 1/02

See application file for complete search history.

(56) References Cited

U.S. PATENT DOCUMENTS

| | | | | |
|---|---|---|---|---|
| 3,498,240 A | | 3/1970 | Trott | |
| 4,384,535 A | * | 5/1983 | McKelvie | F23B 1/16 110/165 R |
| 4,520,791 A | * | 6/1985 | Chamberlain | F24B 5/023 126/198 |
| 4,635,568 A | * | 1/1987 | Angelo, II | F23G 7/06 110/214 |

(Continued)

FOREIGN PATENT DOCUMENTS

EP 2578946 A2 4/2013

*Primary Examiner* — Avinash A Savani
*Assistant Examiner* — Deepak A Deean
(74) *Attorney, Agent, or Firm* — Tarolli, Sundheim, Covell & Tummino LLP

(57) ABSTRACT

A solid fuel burning device has at least one burn chamber wall, a burn chamber base, and an interior burn chamber. The burn chamber base is capable of supporting a combustible solid fuel thereon. At least one of the burn chamber walls is radially offset with respect to another of the burn chamber walls. At least two longitudinally extending air inlets are formed in the space between a first longitudinal edge of at least one of the burn chamber walls and a second longitudinal edge of another burn chamber wall. Each of the longitudinally extending air inlets tangentially directs an entry of air into the interior burn chamber to induce an interior swirl of air in the interior burn chamber. The interior swirl of air in the interior burn chamber causes a flame of a combusting solid fuel to swirl in the interior burn chamber.

24 Claims, 11 Drawing Sheets

(56) References Cited

U.S. PATENT DOCUMENTS

| | | | | |
|---|---|---|---|---|
| 4,672,900 | A | 6/1987 | Santalla et al. | |
| 5,024,208 | A * | 6/1991 | Hottenroth | A47J 37/0763 126/25 R |
| 5,656,043 | A * | 8/1997 | Dobbeling | C10J 3/487 48/108 |
| 9,170,017 | B2 * | 10/2015 | Shimek | F23C 7/004 |
| 9,291,349 | B2 | 3/2016 | Warner | |
| 10,222,092 | B1 * | 3/2019 | Traeger | F24H 3/008 |
| 2003/0194671 | A1 * | 10/2003 | Webb | F23C 3/006 431/159 |
| 2010/0313798 | A1 * | 12/2010 | Murray | F23L 17/00 110/267 |
| 2016/0102865 | A1 * | 4/2016 | Bolton | F23J 15/06 126/75 |

* cited by examiner

APPARATUS AND METHOD FOR BURNING SOLID FUEL

RELATED APPLICATION

This application claims priority from U.S. Provisional Application No. 62/376,466, filed 18 Aug. 2016, the subject matter of which is incorporated herein by reference in its entirety.

TECHNICAL FIELD

This disclosure relates to an apparatus and method for use of a solid fuel burning device and, more particularly, to an apparatus and method for burning solid fuel.

BACKGROUND

Solid fuel burning devices, such as wood burning stoves, coal burning stoves, and fire pits, constitute an inexpensive source of heat. The solid fuel burning devices can be used as a heat source for cooking, and/or for heating people, heating homes, commercial buildings, and any other building. Having adequate airflow through the solid fuel burning devices may lead to higher burning efficiency and lower levels of emissions.

SUMMARY

In an aspect, a solid fuel burning device is provided. The solid fuel burning device has a burn chamber base. The burn chamber base has a burn chamber base first surface. The burn chamber base first surface is capable of supporting a combustible solid fuel thereon. The solid fuel burning device has at least two burn chamber walls. Each of the burn chamber walls has a first end and a second end. The second end of each of the burn chamber walls is disposed on the burn chamber base first surface. Each of the burn chamber walls has a burn chamber wall inner surface and a burn chamber wall outer surface. The burn chamber wall inner surface of each of the burn chamber walls is radially spaced, and oppositely facing, from the burn chamber wall outer surface of a corresponding burn chamber wall. The burn chamber wall inner and outer surfaces of each of the burn chamber walls both extend longitudinally between the first and second ends of each of the burn chamber walls. Each of the burn chamber walls has a first longitudinal edge and an oppositely disposed second longitudinal edge. At least one of the burn chamber walls is radially offset with respect to another of the burn chamber walls such that the first longitudinal edge of the one of the burn chamber walls is radially adjacent to, and spaced apart from, the second longitudinal edge of the other burn chamber wall. An interior burn chamber is defined by the burn chamber wall inner surface of each of the burn chamber walls and the burn chamber base first surface, collectively. At least two longitudinally extending air inlets are formed in the space between the first longitudinal edge of at least one of the burn chamber walls and the second longitudinal edge of another burn chamber wall. Each of the longitudinally extending air inlets tangentially directs an entry of air into the interior burn chamber. Air flowing through the longitudinally extending air inlets into the interior burn chamber induces an interior swirl of air about a central longitudinal axis in the interior burn chamber. The interior swirl of air in the interior burn chamber causes a flame of a combusting solid fuel to swirl about the central longitudinal axis in the interior burn chamber.

In an aspect, a method for burning solid fuel is provided. A solid fuel burning device is provided. The solid fuel burning device has a burn chamber base. The burn chamber base has a burn chamber base first surface. The burn chamber base first surface is capable of supporting a combustible solid fuel thereon. The solid fuel burning device has at least two burn chamber walls. Each of the burn chamber walls has a first end and a second end. The second end of each of the burn chamber walls is disposed on the burn chamber base first surface. Each of the burn chamber walls has a burn chamber wall inner surface and a burn chamber wall outer surface. The burn chamber wall inner surface of each of the burn chamber walls is radially spaced, and oppositely facing, from the burn chamber wall outer surface of a corresponding burn chamber wall. The burn chamber wall inner and outer surfaces of each of the burn chamber walls both extend longitudinally between the first and second ends of each of the burn chamber walls. Each of the burn chamber walls has a first longitudinal edge and an oppositely disposed second longitudinal edge. At least one of the burn chamber walls is radially offset with respect to another of the burn chamber walls such that the first longitudinal edge of the one of the burn chamber walls is radially adjacent to, and spaced apart from, the second longitudinal edge of the other burn chamber wall. An interior burn chamber is defined by the burn chamber wall inner surface of each of the burn chamber walls and the burn chamber base first surface, collectively. At least two longitudinally extending air inlets are formed in the space between the first longitudinal edge of at least one of the burn chamber walls and the second longitudinal edge of another burn chamber wall. A combustible solid fuel is placed into the interior burn chamber. The combustible solid fuel is placed on the burn chamber base first surface in the interior burn chamber. The solid fuel is ignited to combust the solid fuel and form a flame. Air is tangentially directed through each of the longitudinally extending air inlets to induce an interior swirl of air about a central longitudinal axis in the interior burn chamber. The interior swirl of air in the interior burn chamber causes the flame to swirl about the central longitudinal axis in the interior burn chamber.

BRIEF DESCRIPTION OF THE DRAWINGS

For a better understanding, reference may be made to the accompanying drawings, in which.

DESCRIPTION OF EMBODIMENTS

Unless defined otherwise, all technical and scientific terms used herein have the same meaning as is commonly understood by one of ordinary skill in the art to which the present disclosure pertains.

As used herein, the term "user" can be used interchangeably to refer to an individual who prepares for, assists, and/or operates a device.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" can be interpreted to include X and Y.

As used herein, phrases such as "from X to Y" can be interpreted to include X and Y.

It will be understood that when an element is referred to as being "on," "attached" to, "connected" to, etc., another element, it can be directly on, attached to or connected to the other element or intervening elements may also be present. In contrast, when an element is referred to as being, for example, "directly on" another element, there are no intervening elements present. It will also be appreciated by those of skill in the art that references to a structure or feature that is disposed "adjacent" another feature may not have portions that overlap or underlie the adjacent feature.

Spatially relative terms, such as "over" and the like, may be used herein for ease of description to describe one element or feature's relationship to another element(s) or feature(s) as illustrated in the Figures. It will be understood that the spatially relative terms can encompass different orientations of a device in use or operation, in addition to the orientation depicted in the Figures. For example, if a device in the Figures is inverted, elements described as "over" other elements or features would then be oriented "under" or "beneath" the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or Figures unless specifically indicated otherwise.

The invention comprises, consists of, or consists essentially of the following features, in any combination.

Figure 1:
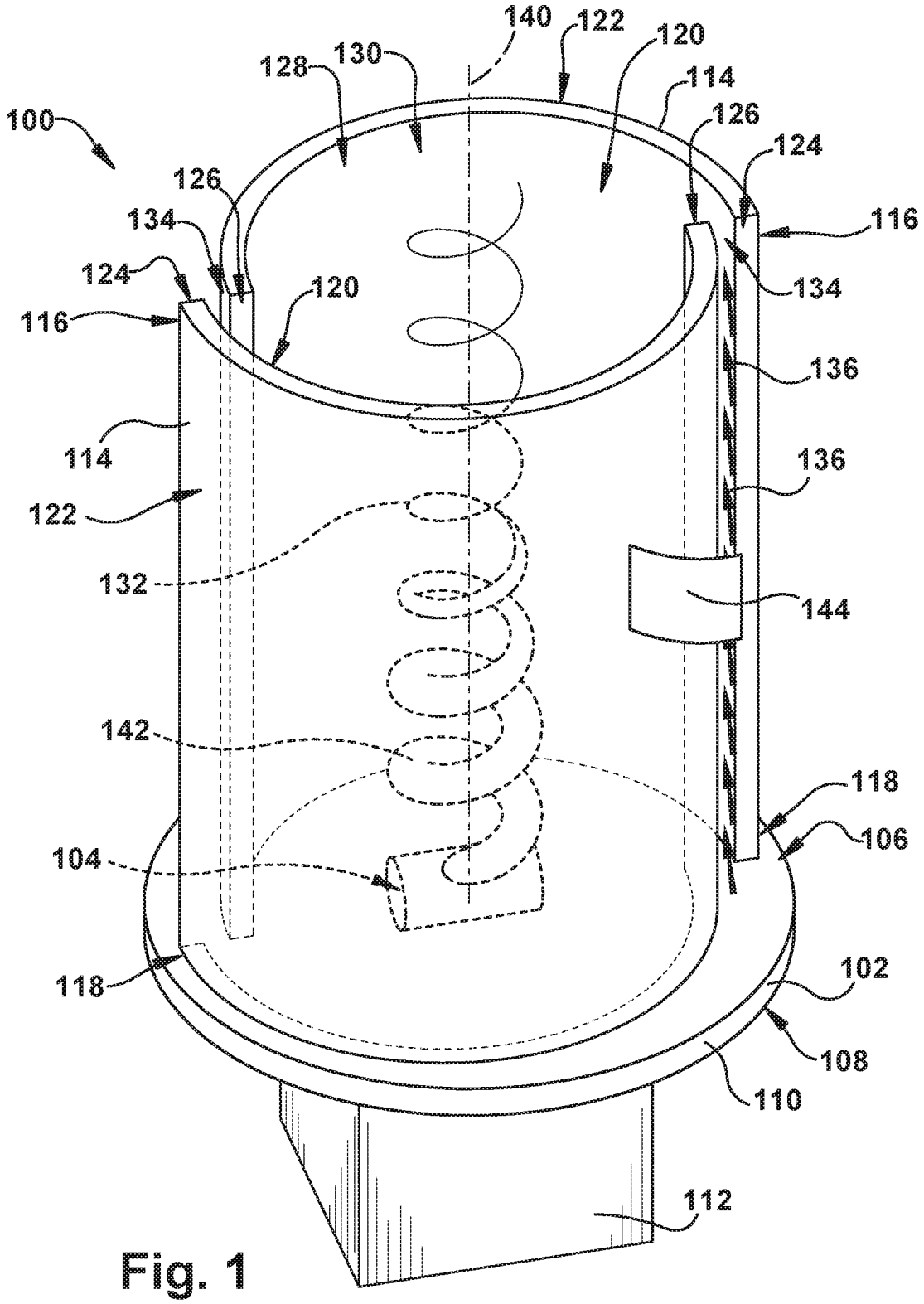
FIG. 1 is a front view of a solid fuel burning device according to one aspect of the present invention.

FIG. 1 depicts a solid fuel burning device 100 that has a burn chamber base 102. The solid fuel 104 may be at least one of wood, coal, wood pellets, corn, other biomass, solid waste, or any other appropriate combustible solid fuel. The burn chamber base 102 has a burn chamber base first surface 106, a burn chamber base second surface 108, and a burn chamber base body 110 longitudinally extending between the burn chamber base first and second surfaces 106, 108. The term "longitudinal" is used herein to indicate a substantially vertical direction, in the orientation of FIG. 1. The burn chamber base second surface 108 being longitudinally spaced, and oppositely facing, from the burn chamber base first surface 106. The burn chamber base first surface 106 is capable of supporting the combustible solid fuel 104 thereon. At least a portion of the burn chamber base second surface 108 may be removably or permanently disposed on a stand 112.

Figure 2:
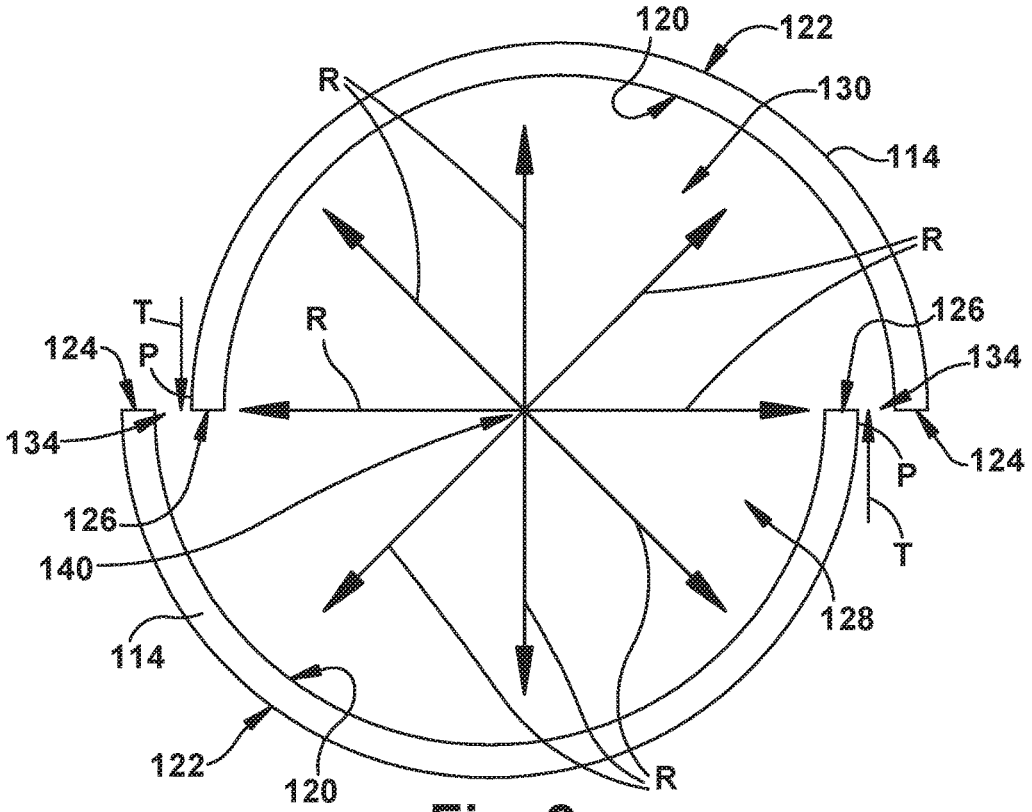
FIG. 2 is a top view of an element of the aspect of FIG. 1.

As shown in FIGS. 1-2, the solid fuel burning device 100 has at least two burn chamber walls 114. Each of the burn chamber walls 114 has a first end 116 and a second end 118. The second end 118 of each of the burn chamber walls 114 is disposed on the burn chamber base first surface 106. Each of the burn chamber walls 114 may be removably or permanently disposed on the burn chamber base first surface 106. Each of the burn chamber walls 114 has a burn chamber wall inner surface 120 and a burn chamber wall outer surface 122. The burn chamber wall inner surface 120 of each of the burn chamber walls 114 is radially spaced, and oppositely facing, from the burn chamber wall outer surface 122 of a corresponding burn chamber wall 114. The term "radial" is used herein to indicate a direction substantially perpendicular to the "longitudinal" direction, and is shown via arrows R in FIG. 2 emanating from a central longitudinal axis 140, as will be described later, in the orientation of FIG. 2. The burn chamber wall inner and outer surfaces 120, 122 of each of the burn chamber walls 114 both extend longitudinally between the first and second ends 116, 118 of each of the burn chamber walls 114. Each of the burn chamber walls 114 has a first longitudinal edge 124 and an oppositely disposed second longitudinal edge 126. At least one of the burn chamber walls 114 is radially offset with respect to another of the burn chamber walls 114 such that the first longitudinal edge 124 of the one of the burn chamber walls 114 is radially adjacent to, and spaced apart from, the second longitudinal edge 126 of the other burn chamber wall 114.

An interior burn chamber 128 is defined by the burn chamber wall inner surface 120 of each of the burn chamber walls 114 and the burn chamber base first surface 106, collectively. The interior burn chamber 128 may have a burn chamber open end 130. The burn chamber open end 130 is longitudinally spaced from the burn chamber base 102. The burn chamber open end 130 is adjacent to the first end 116 of each of the burn chamber walls 114. Solid fuel 104 may be longitudinally inserted downward through the burn chamber open end 130 and onto the burn chamber base first surface 106 in the interior burn chamber 128. Hot gasses 132 from a combusting solid fuel 104 on the burn chamber base first surface 106 may rise longitudinally upward through at least a portion of the interior burn chamber 128 and out of the interior burn chamber 128 through the burn chamber open end 130.

Figure 3:
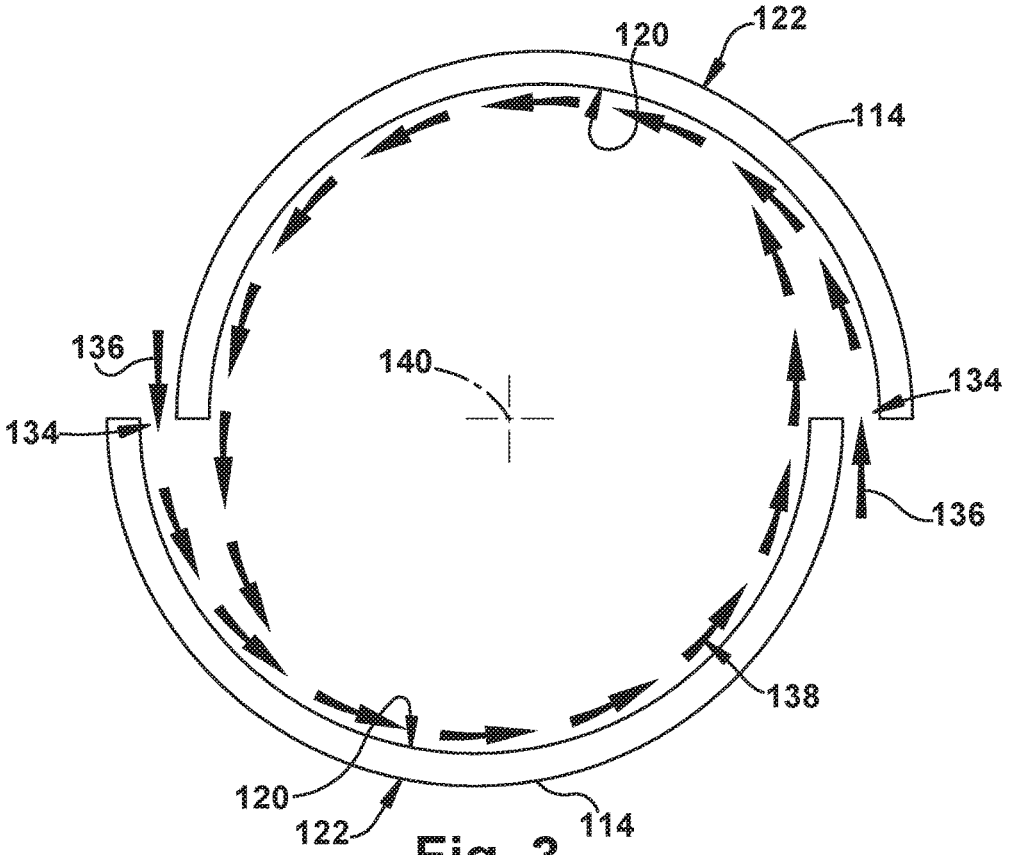
FIG. 3 is a top view of an element of the aspect of FIG. 1.

As shown in FIGS. 1-3, at least two longitudinally extending air inlets 134 are formed in the space between the first longitudinal edge 124 of at least one burn chamber walls 114 and the second longitudinal edge 126 of another burn chamber wall 114. Each of the longitudinally extending air inlets 134 tangentially directs an entry of air into the interior burn chamber 128. The term "tangential" is used herein to indicate a direction substantially perpendicular to the "longitudinal" direction, and is a direction defined by a straight line through at least one fixed point P on at least one of the burn chamber walls outer surfaces 122. Unlike the "radial" direction, the tangential direction does not emanate from the central longitudinal axis 140. The tangential direction is shown via arrows T in FIG. 2.

Air 136 flowing through the longitudinally extending air inlets 134 into the interior burn chamber 128 induces an interior swirl of air 138 about the central longitudinal axis 140 in the interior burn chamber 128. The inducement of the interior swirl of air 138 about the central longitudinal axis 140 in the interior burn chamber 128 may be at least partially caused by the air 136 following along the burn chamber wall inner surface 120 to circulate about the central longitudinal axis 140. The interior swirl of air 138 in the interior burn chamber 128 causes a flame 142 of a combusting solid fuel 104 to swirl about the central longitudinal axis 140 in the interior burn chamber 128.

In other words, the flame is largely made up of air and vaporized fuel. The heat produced by the flame 142 causes the flame 142 to rise in a longitudinally upward direction. The rising flame 142 is met by the interior swirl of air. Because the interior swirl of air 138 forms a vortex flow pattern, the flame 142 is moved by the force of the interior swirl of air 138 to follow the vortex pattern of the interior swirl of air 138, and thus results in a flame with a substantially swirling configuration. The swirling of the flame 142 causes more air to flow to the flame through convection. The addition of air causes the combustion of the vaporized fuel in the flame to increase and consolidate, which in turn causes the flame to elongate. It should be noted that the natural properties of the flame 142 cause the flame 142 to rise from the combusting solid fuel 104. The tangential introduction of air from the longitudinally extending air inlets 134 induces vorticity, or a swirl, into a column. The force of the interior swirl of air 138 causes the flame 142 to elongate and tilt—this tilting is seen locally, but the overall column of swirling flame 142 is substantially vertically oriented. Because the interior swirl of air 138 forms a vortex flow pattern, the flame 142 is moved by the force of the interior swirl of air 138 to follow the vortex pattern of the interior swirl of air 138, and thus the flame 142 to swirl. The swirling flame 142 encourages the combustion of the vaporized fuel in the flame to increase and consolidate, which in turn causes the swirling flame to elongate.

As shown in FIG. 1, at least one forced air supply source 144 may be positioned on the burn chamber wall outer surface 122 of at least one of the burn chamber walls 114. The forced air supply source 144 being positioned adjacent to at least a portion of the longitudinally extending air inlets 134. When activated, the forced air supply source 144 tangentially directs air 136 through the longitudinally extending air inlets 134 and into the interior inner burn chamber 128. The user may control the amount of, and the speed at which, air 136 passes from the forced air supply source 144 and into the longitudinally extending air inlets 134.

Figure 4:
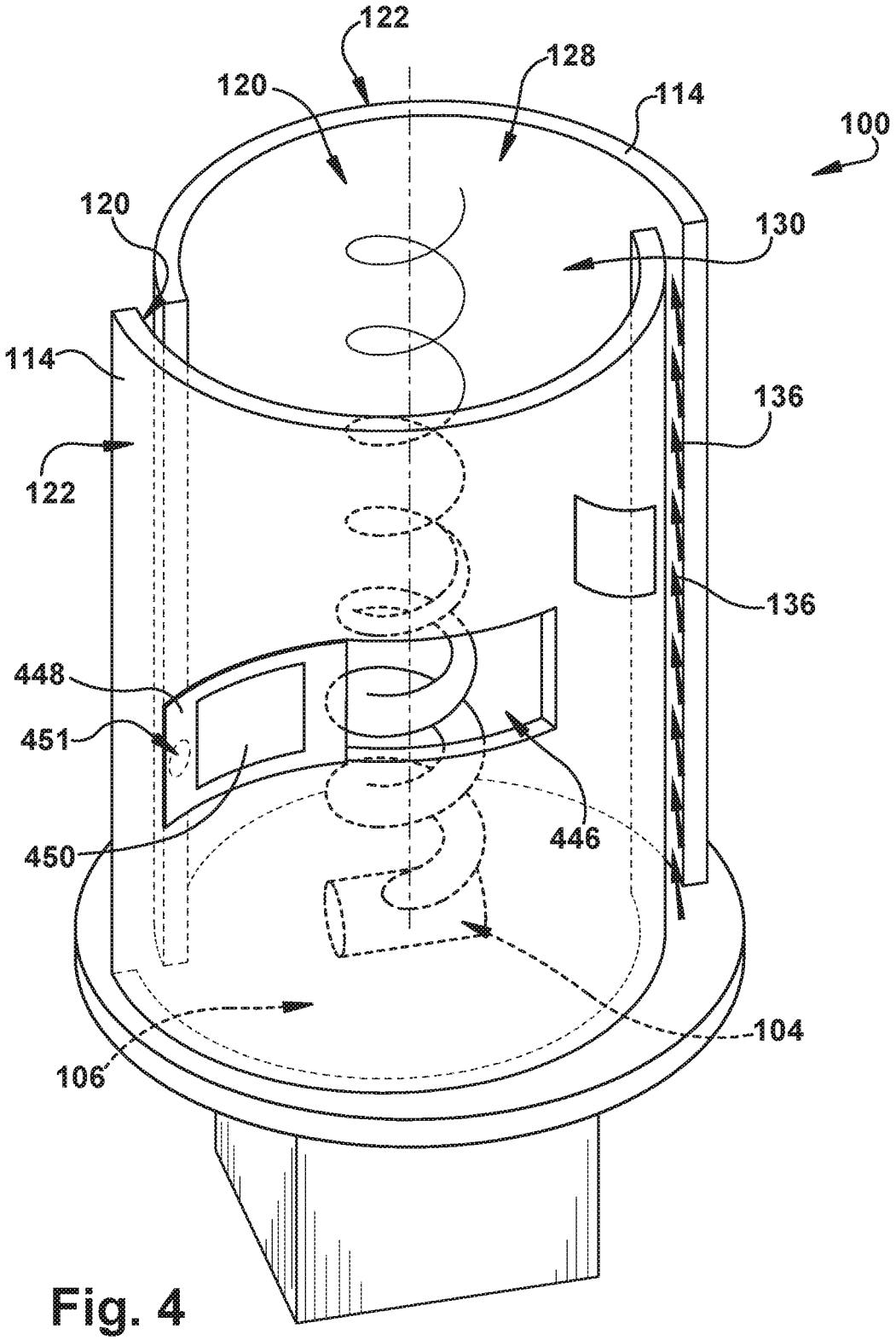
FIG. 4 is a front view the aspect of FIG. 1.

As shown in FIG. 4, at least one of the burn chamber walls 114 may have at least one radially facing burn chamber door opening 446 that extends between the burn chamber wall inner surface 120 and the burn chamber wall outer surface 122. In this configuration, the solid fuel burning device 100 may have a burn chamber door 448 that may move between an open and closed position. When the burn chamber door 448 is in an open position, as is shown in FIG. 4, the radially facing burn chamber door opening 446 places the burn chamber wall outer surface 122 in fluid communication with the interior burn chamber 128 to admit solid fuel 104 therethrough and into the interior burn chamber 128. When the burn chamber door 448 is in the closed position, at least a portion of the burn chamber door 448 at least partially covers the burn chamber door opening 446, and the positioning of the burn chamber door 448 prevents the radially facing burn chamber door opening 446 from placing the burn chamber wall outer surface 122 in fluid communication with the interior burn chamber 128 so that solid fuel 104 may not be admitted therethrough. The burn chamber door 448 may have at least one burn chamber door window 450 that permits a user to see the interior burn chamber 128 even when the burn chamber door 448 is in the closed position. The burn chamber door 448 may have at least one burn chamber door handle 451 that is shaped to be easily gripped by a user.

Figure 5:
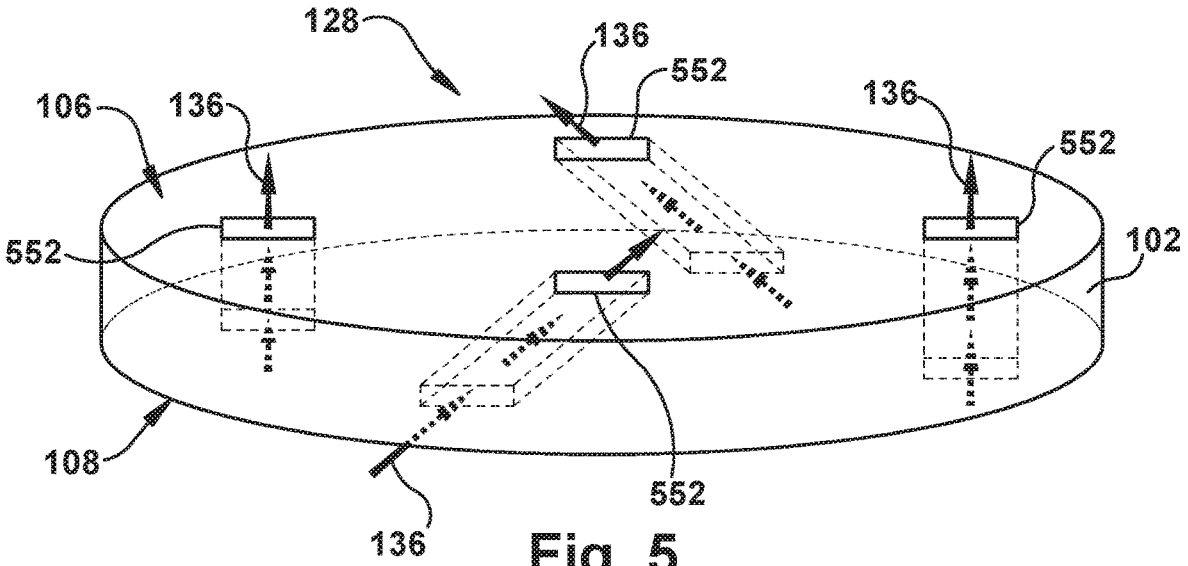
FIG. 5 is a front view of an element of the aspect of FIG. 1.
Figure 6:
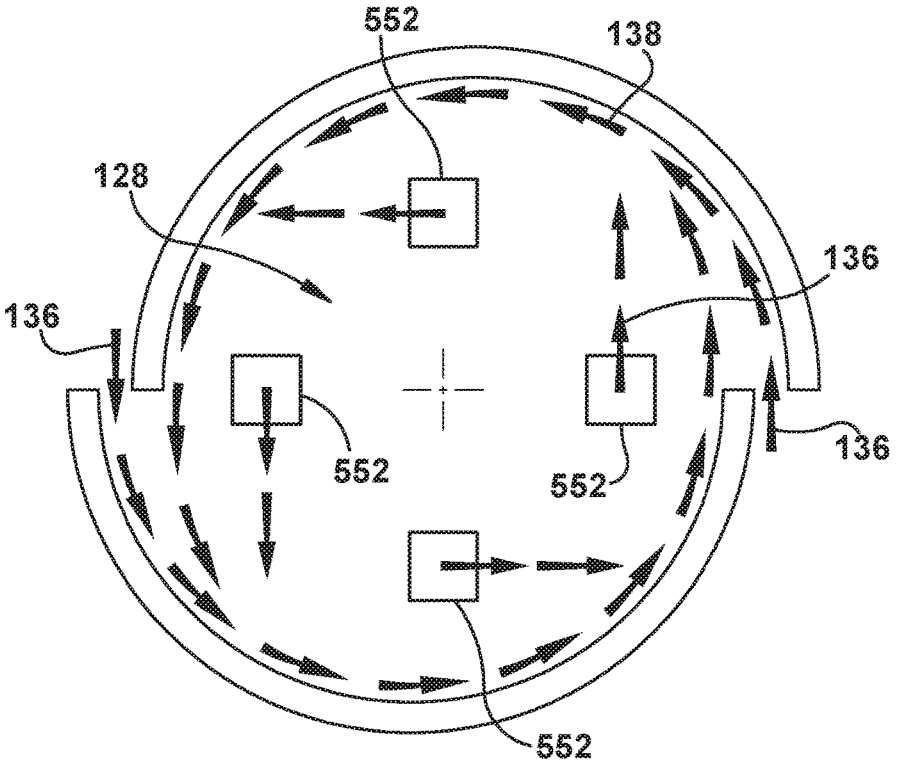
FIG. 6 is a top view of an element of the aspect of FIG. 5.

As shown in FIGS. 5-6, the burn chamber base 102 may have at least one burn chamber base air inlet 552. The burn chamber base air inlet 552 extends between the burn chamber base second surface 108 and the burn chamber base first surface 106. The burn chamber base air inlet 552 places the burn chamber base second surface 108 in fluid communication with the interior burn chamber 128. The burn chamber base air inlet 552 is oriented in such a manner that air 136 passing through the burn chamber base air inlet 552 and into the interior burn chamber 128 assists in the formation of the interior swirl of air 138 in the interior burn chamber 128. This is because the burn chamber base air inlet 552 is oriented such that air passing through the burn chamber base air inlet 552 is caused to swirl in the same direction as the interior swirl of air 138 in the interior burn chamber 128. As shown in FIG. 6, because the air entering the interior burn chamber 128 through the burn chamber base air inlet 552 is swirling in the same direction as the interior swirl of air 138 in the interior burn chamber 128, the swirling air from the burn chamber base air inlet 552 becomes a part of, and thus assists, the interior swirl of air 138 in the interior burn chamber 128.

Figure 7:
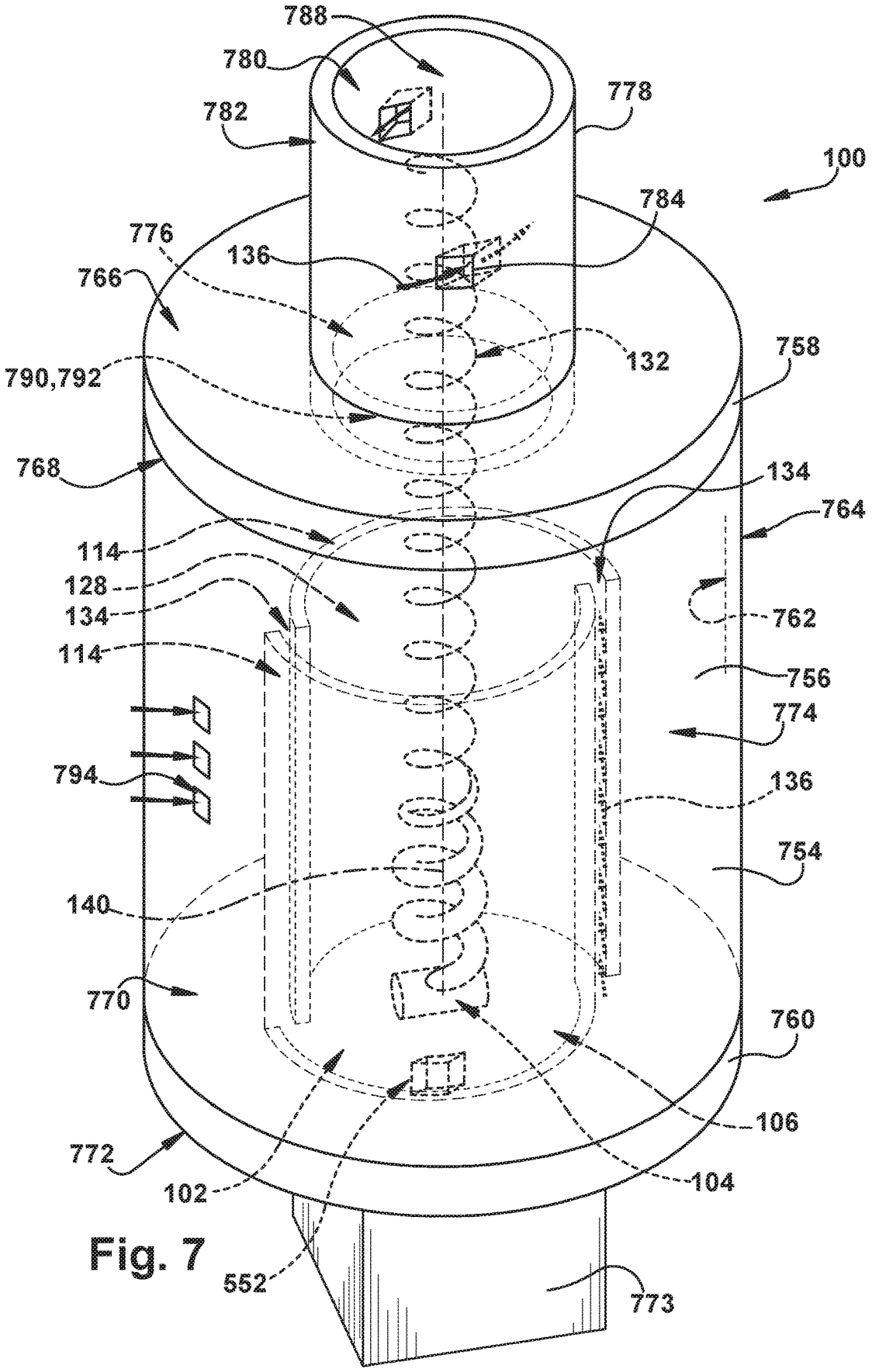
FIG. 7 is a front view of the aspect of FIG. 1.

As shown in FIG. 7, the solid fuel burning device 100 may include a housing 754. The housing 754 has at least one housing wall 756, a housing top 758, and a housing base 760. The housing wall 756 has a housing wall inner surface 762 and a housing wall outer surface 764. The housing wall inner surface 762 being radially spaced, and oppositely facing, from the housing wall outer surface 764. The housing top 758 has a housing top first surface 766 and a housing top second surface 768. The housing top first surface 766 is longitudinally spaced, and oppositely facing, from the housing top second surface 768. The housing base 760 has a housing base first surface 770 and a housing base second surface 772. The housing base first surface 770 is longitudinally spaced, and oppositely facing, from the housing base second surface 772. The housing base second surface 772 may be removably or permanently disposed on a stand 773. A housing inner chamber 774 is defined by the housing wall inner surface 762, the housing base first surface 770, and the housing top second surface 768.

The burn chamber base 102 and the at least two burn chamber walls 114 may be removably or permanently located within the housing inner chamber 774 such that the housing inner chamber 774 is in fluid communication with the interior burn chamber 128 and the longitudinally extending air inlets 134. As shown in FIG. 7, the burn chamber base 102 may comprise at least a portion of the housing base 760 such that the burn chamber base first surface 106 comprises at least a portion of the housing base first surface 770 and the burn chamber base second surface 108 comprises at least a portion of the housing base second surface 772. Alternatively, the burn chamber base second surface 108 may be removably or permanently disposed on the housing base first surface 770. The burn chamber base air inlet 552 may extend from at least one of the burn chamber base second surface 108 and the housing base second surface 772 to at least one of the burn chamber base first surface 106 and the housing base first surface 770 to place at least one of the burn chamber base second surface 108 and the housing base second surface 772 in fluid communication with at least one of the interior burn chamber 128 and the housing inner chamber 774.

As shown in FIG. 7, the housing top 758 may have an exhaust aperture 776 that extends between the housing top first and second surfaces 766, 768. The exhaust aperture 776 places the housing top first surface 766 in fluid communication with the housing inner chamber 774 such that hot gases 132 generated by the combusting solid fuel 104 may exit the interior burn chamber 128 and the housing inner chamber 774 through the exhaust aperture 776. An exhaust stack 778 may be disposed on the housing top first surface 766 over the exhaust aperture 776. The exhaust stack 778 has an exhaust stack inner lumen 780 defined by an exhaust stack outer wall 782. The exhaust stack inner lumen 780 is in fluid communication with the exhaust aperture 776 such that the hot gasses 132 generated in the interior burn chamber 128 may pass through the exhaust aperture 776 into the exhaust stack inner lumen 780, and through the exhaust stack inner lumen 780.

Figure 8:
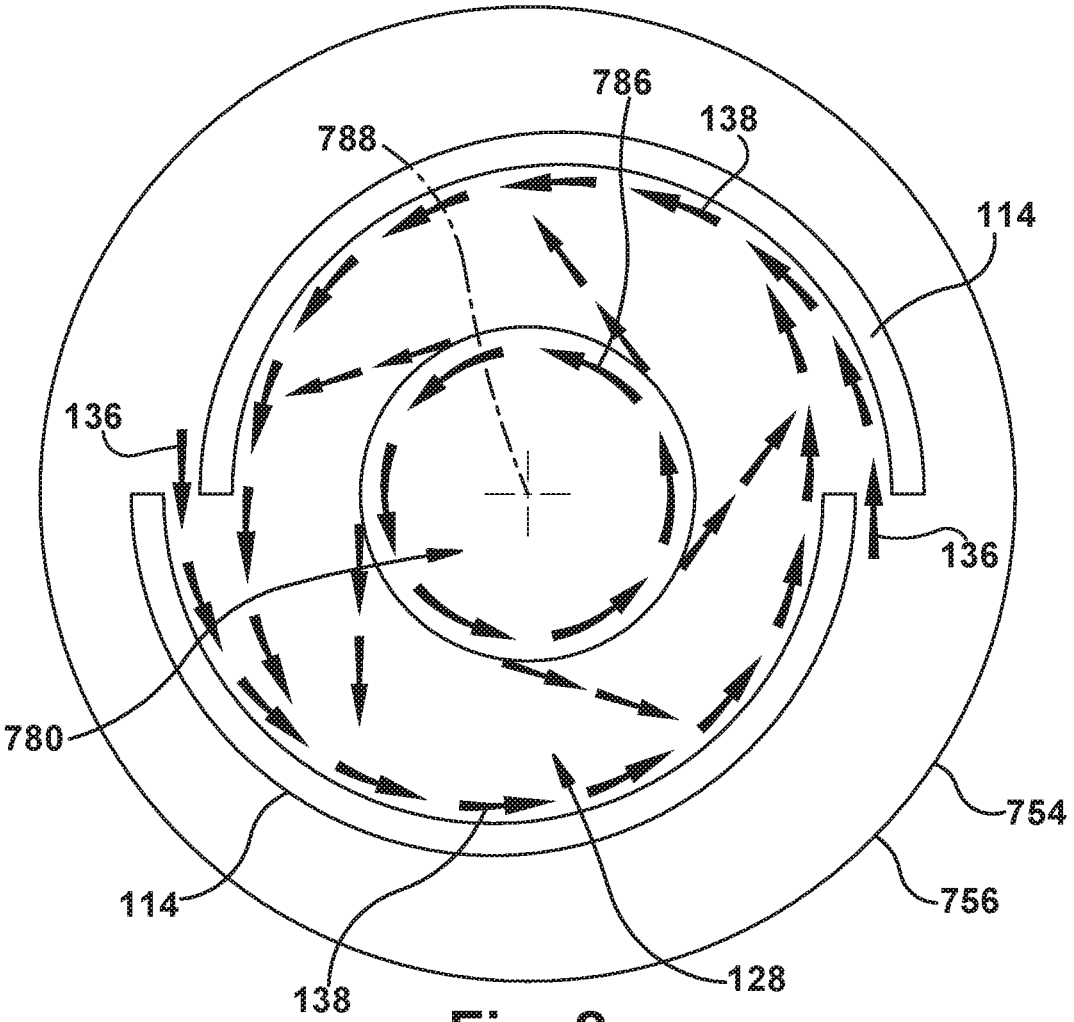
FIG. 8 is a top view of an element of the aspect of FIG. 7.

As shown in FIGS. 7-8, the exhaust stack 778 may have at least one exhaust stack air inlet 784. The exhaust stack air inlet 784 places the exhaust stack outer wall 782 in fluid communication with the exhaust stack inner lumen 780. The exhaust stack air inlet 784 tangentially directs an entry of air into the exhaust stack inner lumen 780. The exhaust stack air inlet 784 is angled in such a manner that air flowing through the exhaust stack air inlet 784 into the exhaust inner lumen 780 induces an interior swirl of air 786 about a central longitudinal axis 788 of the exhaust stack inner lumen 780. As shown in FIG. 8, the interior swirl of air 786 in the exhaust inner lumen 780 may assist in the formation of the interior swirl of air 138 in the interior burn chamber 128. For example, the interior swirl of air 786 in the exhaust inner lumen 780 may swirl longitudinally downward into the interior burn chamber 128. The interior swirl of air 786 from the exhaust inner lumen 780 may swirl in the same direction as the interior swirl of air 138 in the interior burn chamber 128. Therefore, when the interior swirl of air 786 from the exhaust stack inner lumen 780 enters the interior burn chamber 128 and is swirling in the same direction as the interior swirl of air 138 in the interior burn chamber 128, the interior swirl of air 786 from the exhaust inner lumen 780 becomes a part of, and thus assists, the interior swirl of air 138 in the interior burn chamber 128. Referring back to FIG. 7, the central longitudinal axis 788 of the exhaust inner lumen 780 may be aligned with the central longitudinal axis 140 of the interior burn chamber 128 such that the central longitudinal axes 788, 140 of the exhaust stack inner lumen 780 and the interior burn chamber 128 form a single longitudinal axis.

As shown in FIG. 7, the solid fuel burning device 100 may have an exhaust airflow directing device 790. The exhaust airflow directing device 790 may be located in at least one of the exhaust inner lumen 780 and the exhaust aperture 776. Hot gasses 132 generated by the combusting solid fuel 104 may be drawn into and through the exhaust stack inner lumen 780 through the use of the exhaust airflow directing device 790. For example, the exhaust airflow directing device 790 may be a fan 792 having blades or vanes that are shaped to vacuum air from the interior burn chamber 128 and/or the housing inner chamber 774 and through the fan 792. Once the air is sucked from the interior burn chamber 128 and/or the housing inner chamber 774 and through the fan 792, the blades blow the air through the exhaust inner lumen 780 away from the interior burn chamber 128 and/or the housing inner chamber 774.

As shown in FIG. 7, the housing 754 may have at least one housing wall air inlet 794. The housing wall air inlet 794 places the housing wall outer surface 764 in fluid communication with the housing inner chamber 774. Air drawn through the housing wall air inlet 794 and into the housing inner chamber 774 is capable of being tangentially directed through at least one of the longitudinally extending air inlets 134. The at least one housing wall air inlet 794 may be located in any appropriate position throughout the housing wall 756. One or more housing wall air inlets 794 may be positioned adjacent to the housing base 760.

Figure 9:
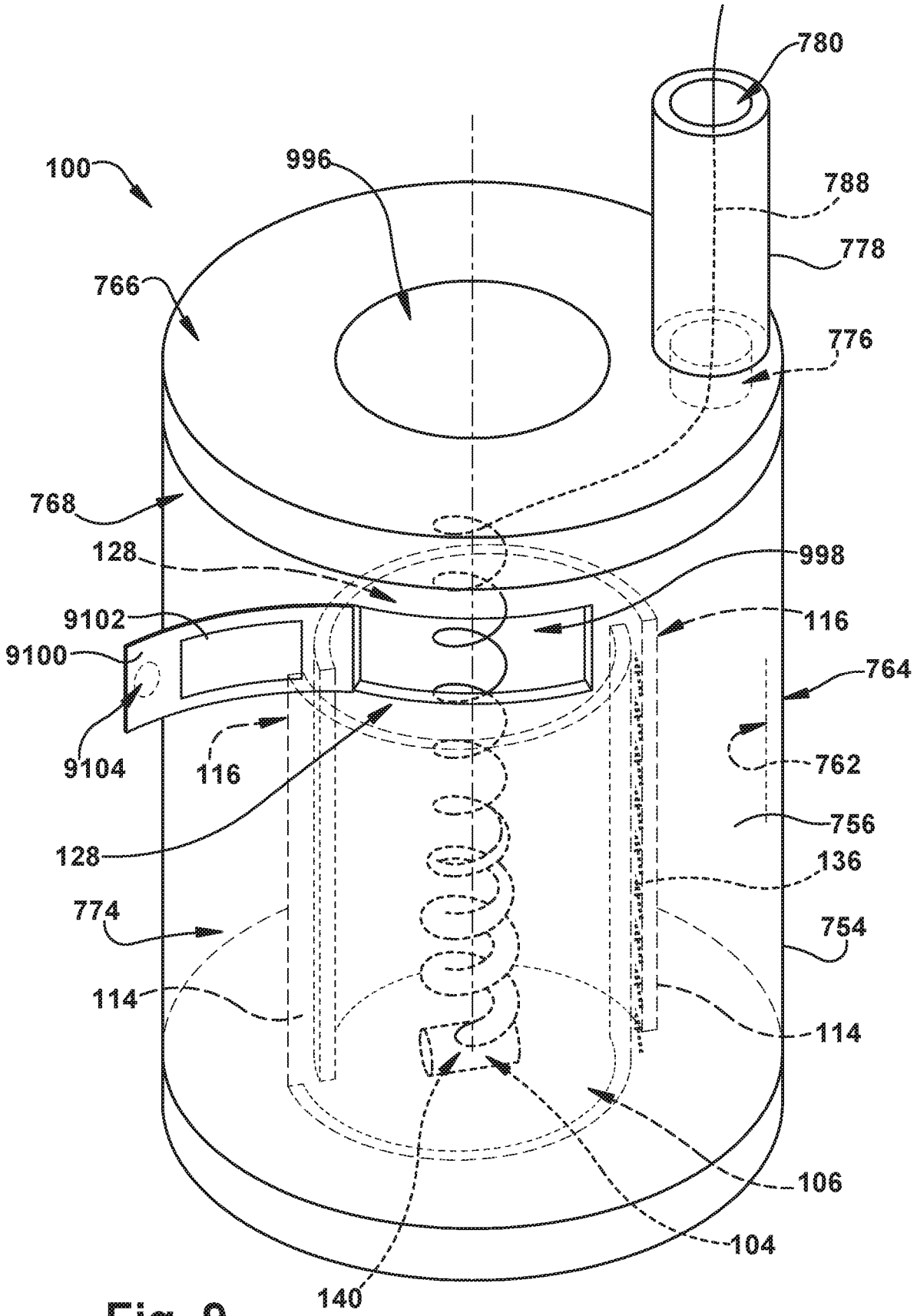
FIG. 9 is a front view of an element of the aspect of FIG. 7 in one example configuration.

As shown in FIG. 9, the central longitudinal axis 788 of the exhaust inner lumen 780 may not be aligned with the central longitudinal axis 140 of the interior burn chamber 128. At least a portion of the housing top first surface 766 may be a cooking surface 996. The term "cooking surface" is defined herein as any surface that is designed to be heated for the intention of heating/cooking food or any other substance directly and/or indirectly thereon.

As shown in FIG. 9, the housing wall 756 may have at least one radially facing housing door opening 998 that extends between the housing wall inner and outer surfaces 762, 764. The housing 754 may have a housing door 9100 that may be moved between an open and a closed position. When the housing door 9100 is in the closed position, at least a portion of the housing door 9100 at least partially covers the housing door opening 998, and the positioning of the housing door 9100 prevents the radially facing housing door opening 998 from placing the housing wall outer surface 764 in fluid communication with the housing inner chamber 774 so that solid fuel 104 may not be admitted therethrough. When the housing door 9100 is in the open position, as shown in FIG. 9, at least a portion of the housing door 9100 is spaced apart from the housing door opening 998, and the radially facing housing door opening 998 places the housing wall outer surface 764 in fluid communication with the housing inner chamber 774 to admit solid fuel 104 therethrough and into the interior burn chamber 128. The housing door 9100 may have at least one housing door window 9102 that permits a user to see the interior burn chamber 128 and/or housing inner chamber 774 even when the housing door 9102 is in the closed position. The housing door 9100 may have at least one housing door handle 9104 that is shaped to be easily gripped by a user.

As shown in FIG. 9, the housing door opening 998 may be located on the housing wall 756 at a position that is longitudinally spaced above the first end 116 of each of the burn chamber walls 114. In this position, solid fuel 104 may be top loaded into the interior burn chamber 128 by a user radially inserting the solid fuel 104 through the housing door opening 998, and then directing the solid fuel 104 to longitudinally downward onto the burn chamber base first surface 106 in the interior burn chamber 128.

Figure 10:
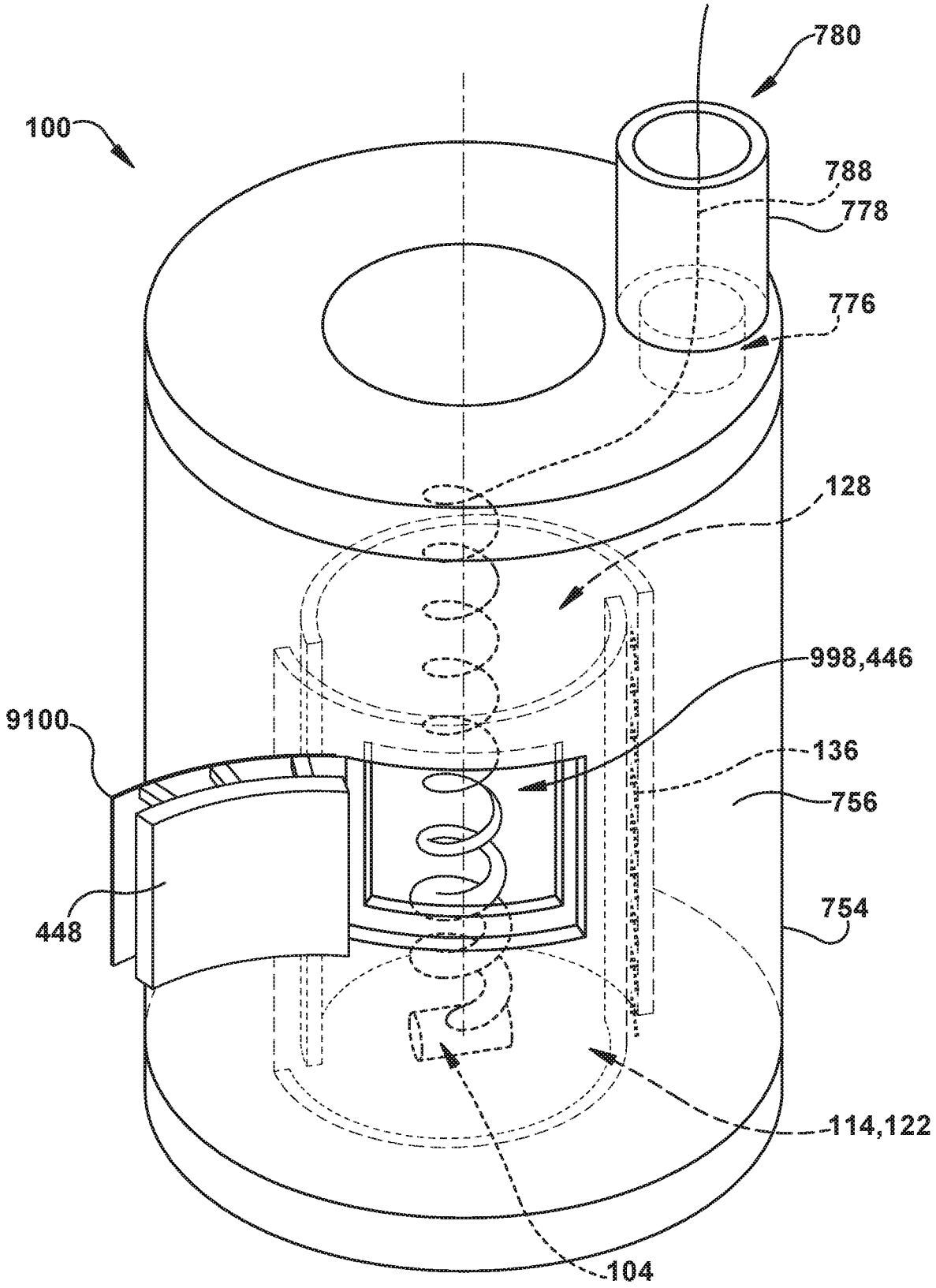
FIG. 10 is a front view of an element of the aspect of FIG. 7 in another example configuration.

As shown in FIG. 10, the housing door opening 998 may be located on the housing wall 756 at a position that is radially parallel to at least a portion of the burn chamber wall outer surface 122 of at least one burn chamber wall 114. In this configuration, the solid fuel burning device 100 may have the at least one burn chamber door opening 446 and the at least one burn chamber door 448. The burn chamber door 448 may be at least partially connected to the housing door 9100 and the burn chamber door opening 446 may be aligned with the housing door opening 998. In this configuration, when the housing door 9100 is moved to the open position, as is shown in FIG. 10, the burn chamber door 448 is concurrently moved to the open position to radially admit solid fuel 104 therethrough and into the interior burn chamber 128.

At least one of the burn chamber walls 114 may comprise at least a portion of the housing wall 756 such that the burn chamber wall inner surface 120 comprises at least a portion of the housing wall inner surface 762, the burn chamber wall outer surface 122 comprises at least a portion of the housing wall outer surface 764, the burn chamber door 9100 comprises at least a portion of the housing door 448, and the burn chamber door opening 446 comprises at least a portion of the housing door opening 998. In this configuration, when the housing door 9100 is in the open position, at least a portion of the housing door 9100 is spaced apart from the housing door opening 998, and the radially facing housing door opening 998 places the housing wall outer surface 764 in fluid communication with the interior burn chamber 128 to admit solid fuel 104 therethrough and into the interior burn chamber 128. Further, when the housing door 9100 is in the closed position, at least a portion of the housing door 9100 at least partially covers the housing door opening 998, and the positioning of the housing door 9100 prevents the radially facing housing door opening 998 from placing the housing wall outer surface 764 in fluid communication with the interior burn chamber 128 so that solid fuel 104 may not be admitted therethrough.

The solid fuel burning device 100 may be fabricated from steel, brick, concrete, tempered glass, glass blocks, wired glass, mica glass, quartz glass, any other suitable heat-resistant material, or any combination thereof. The burn chamber walls 114, the burn chamber base 102, the burn chamber door 448, when provided, the housing wall 756, the housing base 760, the housing top 758, and/or the housing door 9100, when provided, may be at least partially formed from a transparent material so that a user will be able to see into at least one of the interior burn chamber 128 and the housing inner chamber 774.

The below description describes the use of the configuration of the solid fuel burning device 100 shown in FIG. 10, for the sake of example. It should be understood that any of the configurations described above, such as the configuration of FIG. 1, the configuration of FIG. 4, and the configuration of FIG. 9, may be used in a similar sequence of operation.

Figure 11:
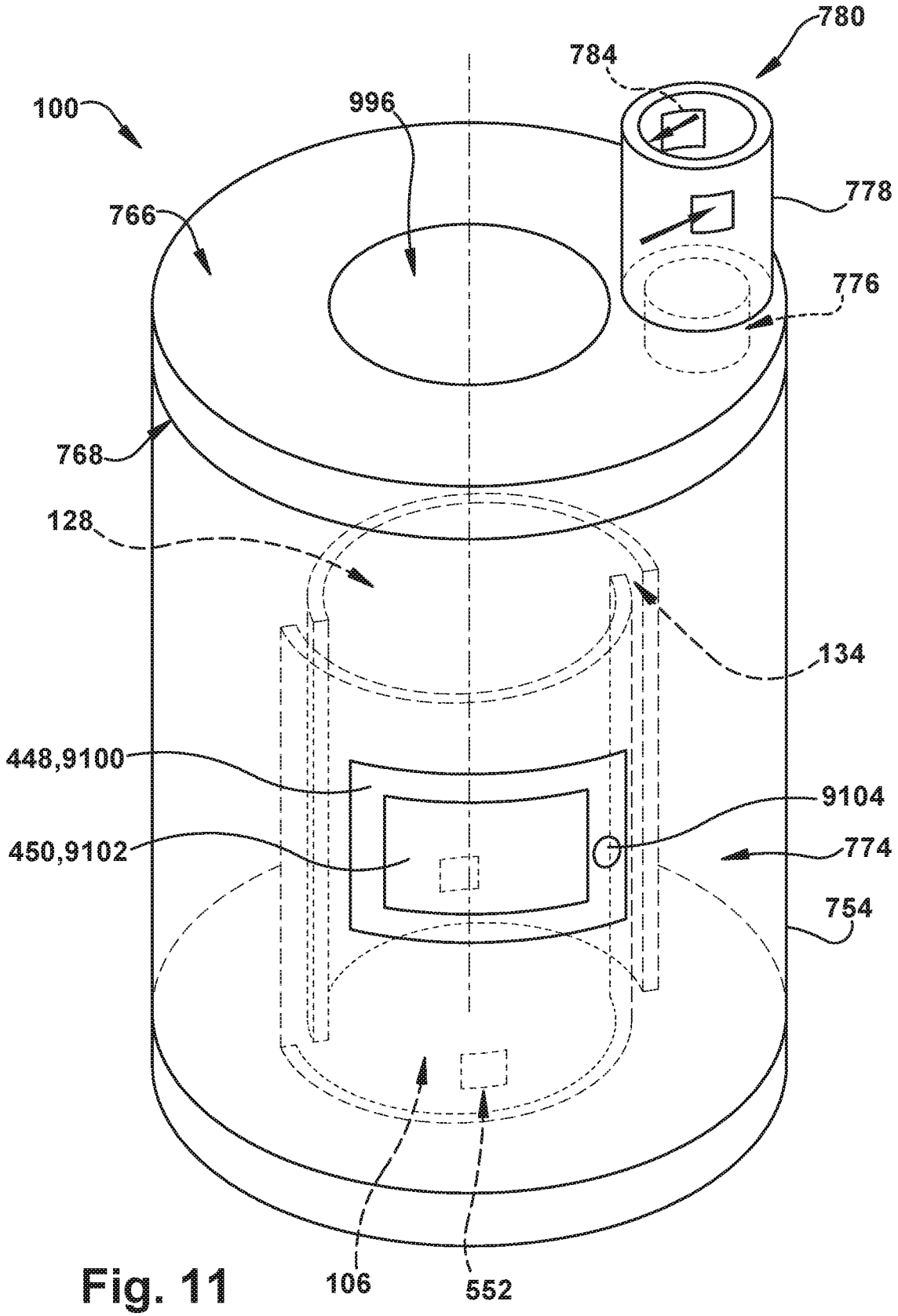
FIGS. 11-13 illustrate an example sequence of operation of the aspect of FIG. 10.
Figure 12:
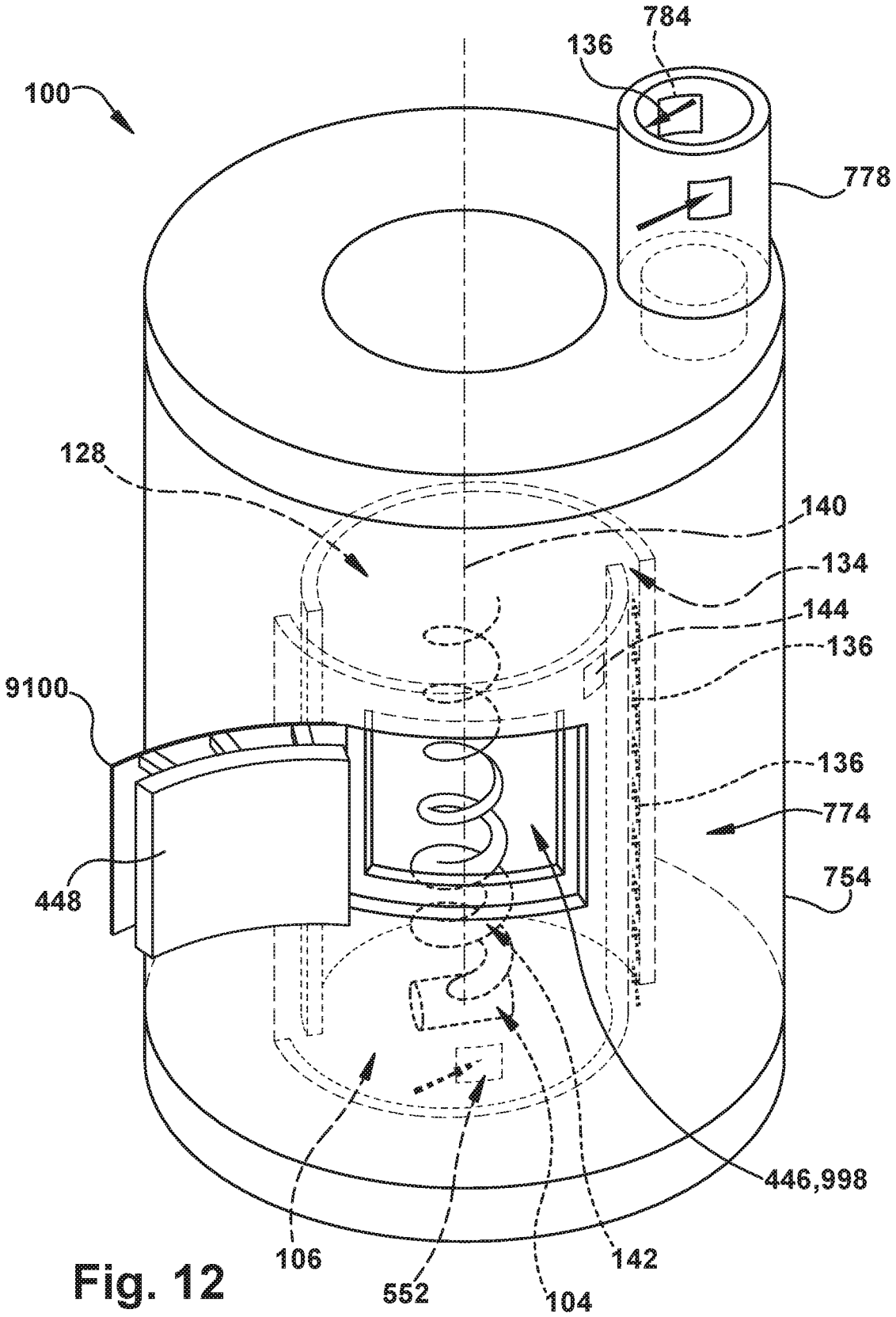

In use, the solid fuel burning device 100, as described above, is provided to the user. The housing door may be moved from the closed position (FIG. 11) to the open position (FIG. 12). If the burn chamber door 448 is at least partially connected to the housing door 9100, as shown in FIG. 12, the moving of the housing door 9100 to the open position concurrently causes the burn chamber door 448 to move to the open position. If the burn chamber door 448 is not at least partially connected to the housing door 9100, after the housing door 9100 is moved to the open position, the burn chamber door 448 is separately moved to the open position.

Figure 13:
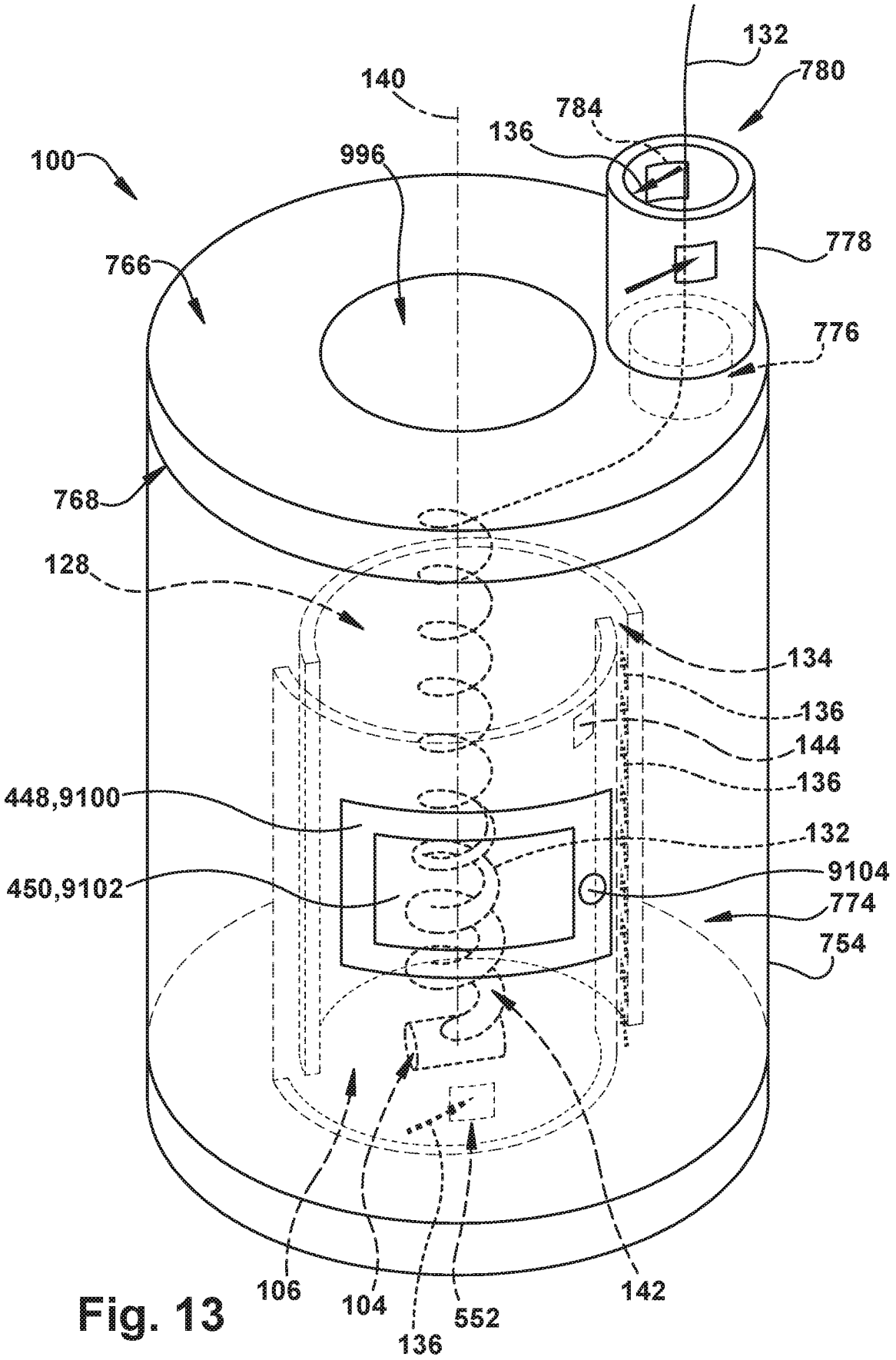

As shown in FIG. 12, with the housing door 9100 and the burn chamber door 448 in the open position, a combustible solid fuel 104 is directed through the housing door opening 998, through the burn chamber door opening 446, and into the interior burn chamber 128. The combustible solid fuel 104 is placed on the burn chamber base first surface 106 in the interior burn chamber 128. The solid fuel 104 is ignited to combust the solid fuel 104 and form a flame 142. As shown in FIG. 13, the housing door 9100 is moved to a closed position. If the burn chamber door 448 is at least partially connected to the housing door 9100, the moving of the housing door 9100 to the closed position concurrently causes the burn chamber door 448 to move to the closed position. If the burn chamber door 448 is not at least partially connected to the housing door 9100, after the burn chamber door 448 is moved to the closed position, the housing door 9100 is separately moved to the closed position.

Air 136 is tangentially directed through each of the longitudinally extending air inlets 134 to induce an interior swirl 138 of air about the central longitudinal axis 140 in the interior burn chamber 128. Air 136 may be tangentially directed through each of the longitudinally extending air inlets 134 through natural convection, such as by the flame 142 drawing air 136 from outside the interior burn chamber 128 into the interior burn chamber 128. When provided, the forced air supply source 144 may tangentially direct air 136 through each of the longitudinally extending air inlets 134. As discussed above, air 136 may be directed through the at least one burn chamber base air inlet, when provided, and into the interior burn chamber 128 to assist in the formation of the interior swirl of air 138 in the interior burn chamber 128. Air 136 may be directed through the at least one exhaust stack air inlet 784, when provided, to induce an interior swirl of air 786 about the central longitudinal axis 788 of the exhaust stack inner lumen 980. As discussed above, the interior swirl of air 786 in the exhaust inner lumen 780 may assist in the formation of the interior swirl of air 138 in the interior burn chamber 128. The interior swirl of air 138 in the interior burn chamber 128 causes the flame 142 to swirl about the central longitudinal axis 140 in the interior burn chamber 128.

Hot gasses 132 generated by the combusting solid fuel 104 in the interior burn chamber 128 may be directed through at least a portion of the interior burn chamber 128, through at least a portion of the housing inner chamber 774, through the exhaust aperture 776, and through the exhaust stack inner lumen 780, when provided. The hot gasses 132 generated by the combusting solid fuel 104 and heat from the flame 142 may heat the housing top second surface 768. The heating of the housing top second surface 768 correspondingly heats the cooking surface 996 of the housing top first surface 766. The user may use the cooking surface 996 to heat, cook, and/or prepare food or any other object that needs to be heated, cooked, or prepared. The user may utilize the housing door window 9102, when provided, and/or the burn chamber door window 450, when provided, to check on the condition of the solid fuel 104 in the interior burn chamber 128.

The configuration of the solid fuel burning device 100 of FIG. 1 may be provided and used in a similar sequence largely as described above. However, solid fuel 104 may be longitudinally directed downward through the burn chamber open end 130 and onto the burn chamber base first surface 106 in the interior burn chamber 128. Hot gasses 132 from the combusting solid fuel 104 on the burn chamber base first surface 106 may rise longitudinally upward through at least a portion of the interior burn chamber 128 and out of the interior burn chamber 128 through the burn chamber open end 130. Thus, the housing door 9100, the housing door opening 998, the burn chamber door 448, the burn chamber door opening 446, the exhaust stack 778, and/or the exhaust aperture 776 may not be required and/or present.

The configuration of the solid fuel burning device 100 of FIG. 4 may be provided and used in a similar sequence largely as described above. However, the solid fuel may be longitudinally directed downward through the burn chamber open end 130 and onto the burn chamber base first surface 106 in the interior burn chamber 128. Instead of, or in addition to the solid fuel 104 being longitudinally directed downward through the burn chamber open end 130, the burn chamber door may be utilized to admit solid fuel 104 therethrough. In this sequence, the burn chamber door 448 is moved to the open position. With the burn chamber door 448 in the open position, solid fuel 104 is directed through the burn chamber door opening 446 and into the interior burn chamber 128. The solid fuel 104 is placed on the burn chamber base first surface 106 in the interior burn chamber 128. The solid fuel 104 is ignited to combust the solid fuel 104 and form the flame 142. The burn chamber door 448 is moved to the closed position. Hot gasses 132 from the combusting solid fuel 104 on the burn chamber base first surface 106 may rise longitudinally upward through at least a portion of the interior burn chamber 128 and out of the interior burn chamber 128 through the burn chamber open end 130. Thus, the housing door 9100, the housing door opening 998, the exhaust stack 778, and/or the exhaust aperture 776 may not be required and/or present.

The configuration of the solid fuel burning device 100 of FIG. 9 may be provided and used in a similar sequence largely as described above. However, the housing door 9100 is moved to the open position. With the housing door 9100 in the open position, solid fuel 104 is radially inserted though the housing door opening 998 to a position above the interior burn chamber 128. With the solid fuel 104 inserted through the housing door opening 998 and above the interior burn chamber 128, the solid fuel 104 is longitudinally directed downward onto the burn chamber base first surface 106 in the interior burn chamber 128. The solid fuel 104 is ignited to combust the solid fuel 104 and form the flame 142. The housing door 9100 is moved to the closed position. Thus, the burn chamber door 448 and/or the burn chamber door opening 446 would not be required.

The solid fuel burning device 100 assists the user in providing heat to the user, other people, animals, a house, a commercial building, any other building, a cooking surface, any other suitable object that may require and/or desire to be heated, or any combination thereof.

The solid fuel burning device may demonstrate high burn efficiency and low levels of emission. In particular, the swirling of the flame 142 may induce a rapid and thorough mixing of vaporized fuel from the combusting solid fuel 104 and oxygen. This rapid and thorough mixing leads to high local temperatures and short "mixing times". Short mixing times and high temperatures are both strongly related to complete combustion. The phrase "complete combustion" is defined herein as a reaction of hydrocarbon fuel with oxygen that produces only carbon dioxide, water, and heat. When combustion is "incomplete," carbon monoxide, unburned hydrocarbons, and particulate matter, such as soot, is produced. These products from incomplete combustion constitute harmful emissions and contain unrealized potential energy that could be recovered by their complete combustion. By completely combusting the vaporized fuel, which the swirling flame 142 facilitates, there are fewer harmful emissions produced and more heat that can be extracted from a unit of solid fuel 104.

Although the burn chamber interior, the housing, and exhaust stack has been shown as being substantially cylindrical, it should be understood that the interior burn chamber, the housing, and/or the exhaust stack may have any other suitable shape such as rectangular, square, cone, etc.

It is contemplated that at least one housing wall air inlet 794 may be positioned in the housing wall 756 at any desired location, including a location that is radially opposite to the housing door opening 998.

It is contemplated that the longitudinally extending air inlets 134, the burn chamber base air inlet 552, when provided, and/or the exhaust stack air inlet 784, when provided, may be able to be moved to an open position to allow the passage of air therethrough, moved to a closed position to prevent the passage of air therethrough, and/or moved to an intermediate position between the open and closed positions in order to control the amount of air passing therethrough.

It is contemplated that the user may be able to selectively adjust the burn chamber door 448, when provided, the housing door 9100, when provided, the longitudinally extending air inlets 134, the burn chamber base air inlet 552, when provided, and/or the exhaust stack air inlet 784, when provided, to the open position, the closed position, or to an intermediate position between the open and closed positions through direct, physical action and/or through direct, remote action.

It is contemplated that the user may ignite the solid fuel 104 by use of a torch, a lighter, a match, any other appropriate fire starter, or any combination thereof through direct, physical action and/or through indirect, remote action.

It is contemplated that at least one of the housing top 758 and the housing base 760 may be removably attached to the at least one housing wall 756. This configuration may be beneficial in allowing the user to easily clean at least one of the housing top 758, the housing base 760, and the housing walls 756. Further, in this configuration, with the housing top 758 removed from the housing wall 756 and the housing base 760 attached to the housing wall 756, the user may direct the solid fuel 104 longitudinally downward through an opening that was occupied by the housing top 758 and onto the burn chamber base first surface 106 in the interior burn chamber 128.

It is contemplated that the burn chamber base 102 could be solid with no air inlets, solid with air inlets above the surface of the base, or could be a grated (e.g., perforated) surface to allow the passage of ash or fuel waste to a suitable collection system below with or without air inlets. In most use environments including air inlets, the air could be supplied substantially as shown in the Figures (i.e., tangentially), so as to induce swirl in a similar manner to the tangential swirl induced by the offset walls.

It is contemplated that at least a portion of the burn chamber base first surface 106 may be a grate. In this configuration, the burn chamber base body 110 may house a removable burn chamber base waste receptacle. The grated burn chamber base first surface 106 may have at least one burn chamber base passageway that extends between the burn chamber base first surface 106 and the burn chamber base waste receptacle. Ash and/or solid fuel waste generated by the combusting solid fuel 104 is capable of passing through the burn chamber base passageway and into the burn chamber base waste receptacle. The burn chamber base waste receptacle may be removed from the burn chamber base to facilitate emptying and cleaning the burn chamber base waste receptacle. In this configuration the burn chamber base may have at least one burn chamber base air inlet 552, as described above.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. A solid fuel burning device, comprising:

a burn chamber base having a burn chamber base first surface, the burn chamber base first surface being capable of supporting a combustible solid fuel thereon;

at least two burn chamber walls, each of the burn chamber walls having a first end and a second end, the second end of each of the burn chamber walls being disposed on the burn chamber base first surface, each of the burn chamber walls having a burn chamber wall inner surface and a burn chamber wall outer surface, the burn chamber wall inner surface of each of the burn chamber walls being radially spaced, and oppositely facing, from the burn chamber wall outer surface of a corresponding burn chamber wall, the burn chamber wall inner and outer surfaces of each of the burn chamber walls both extending longitudinally between the first and second ends of each of the burn chamber walls, each of the burn chamber walls having a first longitudinal edge and an oppositely disposed second longitudinal edge, at least one of the burn chamber walls being radially offset with respect to another of the burn chamber walls such that the first longitudinal edge of the one of the burn chamber walls is radially adjacent to, and spaced apart from, the second longitudinal edge of the other burn chamber wall;

an interior burn chamber being defined by the burn chamber wall inner surface of each of the burn chamber walls and the burn chamber base first surface, collectively; and at least two longitudinally extending air inlets being formed in the space between the first longitudinal edge of at least one of the burn chamber walls and the second longitudinal edge of another burn chamber wall, each of the longitudinally extending air inlets tangentially directing an entry of air into the interior burn chamber;

wherein air flowing through the longitudinally extending air inlets into the interior burn chamber induces an interior swirl of air about a central longitudinal axis in the interior burn chamber, the interior swirl of air in the interior burn chamber causing a flame of a combusting solid fuel to swirl about the central longitudinal axis in the interior burn chamber, wherein the interior burn chamber has a substantially constant cross-sectional area longitudinally therewithin.

2. The solid fuel burning device of claim 1, wherein the burn chamber base has a burn chamber base second surface, the burn chamber base second surface being longitudinally spaced, and oppositely facing, from the burn chamber base first surface, a burn chamber base body longitudinally extending between the burn chamber base first and second surfaces, at least one burn chamber base air inlet extending between the burn chamber second surface and the burn chamber first surface, the burn chamber base air inlet placing the burn chamber base second surface in fluid communication with the interior burn chamber, the burn chamber base air inlet being oriented in such a manner that air passing through the burn chamber base air inlet and into the interior burn chamber assists in the formation of the interior swirl of air in the interior burn chamber.

3. The solid fuel burning device of claim 1, wherein the burn chamber base has a burn chamber base second surface and a burn chamber base body longitudinally extending between the burn chamber base first surface and the burn chamber base second surface, at least a portion of the burn chamber base second surface being disposed on a stand.

4. The solid fuel burning device of claim 1, including at least one forced air supply source, the forced air supply source being positioned adjacent to at least a portion of the longitudinally extending air inlets, the forced air supply source tangentially directing air through the longitudinally extending air inlets and into the interior inner burn chamber.

5. The solid fuel burning device of claim 1, wherein at least one of the burn chamber walls has at least one radially facing burn chamber door opening that extends between the burn chamber wall inner surface and the burn chamber wall outer surface, the solid fuel burning device including a burn chamber door, wherein, when the burn chamber door is in an open position, the radially facing burn chamber door opening places the burn chamber wall outer surface in fluid communication with the interior burn chamber to admit solid fuel therethrough and into the interior burn chamber.

6. The solid fuel burning device of claim 1, including a housing having at least one housing wall, a housing top, and a housing base, a housing inner chamber being defined by a housing wall inner surface, a housing base first surface, and a housing top second surface, the burn chamber base and the at least two burn chamber walls being located within the housing inner chamber such that the housing inner chamber is in fluid communication with the interior burn chamber and the longitudinally extending air inlets.

7. The solid fuel burning device of claim 6, wherein the burn chamber base comprises at least a portion of the housing base such that the burn chamber first surface comprises at least a portion of the housing base first surface.

8. The solid fuel burning device of claim 6, wherein the burn chamber base is disposed on the housing base first surface.

9. The solid fuel burning device of claim 6, wherein the housing wall has a housing wall outer surface, the housing wall inner surface being radially spaced, and oppositely facing, from the housing wall outer surface, the housing wall having at least one radially facing housing door opening that extends between the housing wall inner and outer surfaces, the housing including a housing door, when the housing door is in an open position, the radially facing door opening places the housing wall outer surface in fluid communication with the housing inner chamber to admit solid fuel therethrough and into the interior burn chamber.

10. The solid fuel burning device of claim 9, wherein at least one of the burn chamber walls has at least one radially facing burn chamber door opening that extends between the burn chamber wall inner and outer surfaces, the solid fuel burning device including at least one burn chamber door, when the burn chamber door is in an open position, the radially facing burn chamber door opening places the burn chamber wall outer surface in fluid communication with the interior burn chamber, the burn chamber door being at least partially connected to the housing door, the burn chamber door opening being aligned with the housing door opening;

wherein, when the housing door is moved to the open position, the burn chamber door is concurrently moved to the open position to admit solid fuel therethrough and into the interior burn chamber.

11. The solid fuel burning device of claim 6, wherein the housing wall has a housing wall outer surface, the housing wall inner surface being radially spaced, and oppositely facing, from the housing wall outer surface, at least one housing wall air inlet placing the housing wall outer surface in fluid communication with the housing inner chamber such that air drawn through the housing wall air inlet and into the housing inner chamber is capable of being tangentially directed through at least one of the longitudinally extending air inlets.

12. The solid fuel burning device of claim 6, wherein the housing top has a housing top first surface that is longitudinally spaced, and oppositely facing, from the housing top second surface, the housing top having an exhaust aperture that extends between the housing top first and second surfaces, the exhaust aperture placing the housing top first surface in fluid communication with the housing inner chamber such that hot gases generated by the combusting solid fuel exit the inner burn chamber and housing inner chamber through the exhaust aperture.

13. The solid fuel burning device of claim 12, including an exhaust stack, the exhaust stack being disposed on the housing top first surface over the exhaust aperture, an exhaust stack inner lumen being in fluid communication with the exhaust aperture such that the hot gasses generated in the interior burn chamber pass through the exhaust aperture into the exhaust stack inner lumen, and through the exhaust stack inner lumen.

14. The solid fuel burning device of claim 13, wherein the exhaust stack has an exhaust stack outer wall, the exhaust stack having at least one exhaust stack air inlet, the exhaust stack air inlet placing the exhaust stack outer wall in fluid communication with the exhaust stack inner lumen, the exhaust stack air inlet tangentially directing an entry of air into the exhaust stack inner lumen, the exhaust air inlet being angled in such a manner that air flowing through the exhaust air inlet into the exhaust stack inner lumen induces an interior swirl of air about a central longitudinal axis of the exhaust stack inner lumen, the interior swirl of air in the exhaust stack inner lumen assists in the formation of the interior swirl of air in the interior burn chamber.

15. The solid fuel burning device of claim 14, wherein hot gases generated by the combusting sold fuel are drawn into and through the exhaust stack inner lumen through the use of an exhaust airflow directing device.

16. The solid fuel burning device of claim 13, wherein at least a portion of the housing top first surface is a cooking surface, the hot gasses generated by the combusting solid fuel and the flame heating the housing top second surface, and the heated housing top second surface correspondingly heating the cooking surface of the housing top first surface.

17. The solid fuel burning device of claim 1, wherein each of the burn chamber walls extends substantially perpendicularly from the burn chamber base first surface.

18. A method of burning solid fuel, the method comprising:

providing a solid fuel burning device including a burn chamber base having a burn chamber base first surface, the burn chamber base first surface being capable of supporting a combustible solid fuel thereon;

at least two burn chamber walls, each of the burn chamber walls having a first end and a second end, the second end of each of the burn chamber walls being disposed on the burn chamber base first surface, each of the burn chamber walls having a burn chamber wall inner surface and a burn chamber wall outer surface, the burn chamber wall inner surface of each of the burn chamber walls being radially spaced, and oppositely facing, from the burn chamber wall outer surface of a corresponding burn chamber wall, the burn chamber wall inner and outer surfaces of each of the burn chamber walls both extending longitudinally between the first and second ends of each of the burn chamber walls, each of the burn chamber walls having a first longitudinal edge and an oppositely disposed second longitudinal edge, at least one of the burn chamber walls being radially offset with respect to another of the burn chamber walls such that the first longitudinal edge of the one of the burn chamber walls is radially adjacent to, and spaced apart from, the second longitudinal edge of the other burn chamber wall;

an interior burn chamber being defined by the burn chamber wall inner surface of each of the burn chamber walls and the burn chamber base first surface, collectively; and at least two longitudinally extending air inlets being formed in the space between the first longitudinal edge of at least one of the burn chamber walls and the second longitudinal edge of another burn chamber wall, each of the longitudinally extending air inlets tangentially directing an entry of air into the interior burn chamber;

placing a combustible solid fuel into the interior burn chamber;

placing the combustible solid fuel on the burn chamber base first surface in the interior burn chamber;

igniting the solid fuel to combust the solid fuel and form a flame; and directing air tangentially through each of the longitudinally extending air inlets to induce an interior swirl of air about a central longitudinal axis in the interior burn chamber, the interior swirl of air in the interior burn chamber causing the flame to swirl about the central longitudinal axis in the interior burn chamber, wherein the interior burn chamber has a substantially constant cross-sectional area longitudinally therewithin.

19. The method of claim 18, including directing air through a burn chamber base air inlet and into the interior burn chamber to assist in the formation of the interior swirl of air in the interior burn chamber, the burn chamber base air inlet extending between the burn chamber base first surface and a burn chamber base second surface, the burn chamber base air inlet placing the burn chamber base second surface in fluid communication with the interior burn chamber, the burn chamber base air inlet being oriented in such a manner that air passing through the burn chamber base air inlet and into the interior burn chamber assists in the formation of the interior swirl of air in the interior burn chamber, the burn chamber base second surface being longitudinally spaced, and oppositely facing, from the burn chamber base first surface.

20. The method of claim 18, including activating at least one forced air supply source to tangentially direct air through the longitudinally extending air inlets and into the interior burn chamber, the forced air supply source being positioned adjacent to at least a portion of the longitudinally extending air inlets.

21. The method of claim 18, wherein at least one of the burn chamber walls has at least one radially facing burn chamber door opening that extends between the burn chamber wall inner and outer surfaces, the solid fuel burning device including a burn chamber door, when the burn chamber door is in an open position, the radially facing burn chamber door opening places the burn chamber wall outer surface in fluid communication with the interior burn chamber, the method further including: moving the burn chamber door to the open position; with the burn chamber door in the open position, directing solid fuel through the burn chamber door opening; and moving the burn chamber door to a closed position.

22. The method of claim 18, including: providing a housing having at least one housing wall, a housing top, and a housing base, a housing inner chamber being defined by a housing wall inner surface, a housing base first surface, and a housing top second surface, the burn chamber base and the at least two burn chamber walls being located within the housing inner chamber such that the housing inner chamber is in fluid communication with the interior burn chamber and the longitudinally extending air inlets, the housing wall having a housing wall outer surface, the housing wall inner surface being radially spaced, and oppositely facing, from the housing wall outer surface, the housing wall having at least one radially facing housing door opening that extends between the housing wall inner and outer surfaces, the housing including a housing door, when the housing door is in an open position, the radially facing door opening places the housing wall outer surface in fluid communication with the housing inner chamber; moving the housing door to the open position; with the housing door in the open position, directing solid fuel through the housing door opening; and moving the housing door to a closed position.

23. The method of claim 22, wherein at least one of the burn chamber walls has at least one radially facing burn chamber door opening that extends between the burn chamber wall inner and outer surfaces, the solid fuel burning device including a burn chamber door, when the burn chamber door is in an open position, the radially facing burn chamber door opening places the burn chamber wall outer surface in fluid communication with the interior burn chamber, the burn chamber door being at least partially connected to the housing door, the burn chamber door opening being aligned with the housing door opening, the method further including: moving the housing door into the open position, the moving of the housing door to the open position concurrently causing the burn chamber door to move to the open position; with the housing door and the burn chamber door in the open position, directing the solid fuel through the housing door opening, through the burn chamber door opening, and into the interior burn chamber; and moving the housing door to a closed position, the moving of the housing door to the closed position concurrently causing the burn chamber door to move to the closed position.

24. The method of claim 21, wherein the housing top has a housing top first surface that is longitudinally spaced, and oppositely facing, from the housing top second surface, the housing top having an exhaust aperture that extends between the housing top first and second surfaces, the exhaust aperture placing the housing top first surface in fluid communication with the housing inner chamber, an exhaust stack being disposed on the housing top first surface over the exhaust aperture, an exhaust stack inner lumen being in fluid communication with the exhaust aperture, at least a portion of the housing top first surface being a cooking surface, the method further including: heating the housing top second surface with the hot gasses generated by the combusting solid fuel and heat from the flame, the heating of the top second surface correspondingly heats the cooking surface of the housing top first surface; and directing the hot gasses generated in the interior burn chamber through at least a portion of the interior burn chamber, through at least a portion of the housing inner chamber, and through the exhaust aperture and the exhaust stack inner lumen.

* * * * *